United States Patent [19]

Bazarov et al.

[11] 4,395,228

[45] Jul. 26, 1983

[54] ROTARY BURNER FOR LIQUID FUELS

[76] Inventors: Vladimir G. Bazarov, ulitsa Matveevskaya, 42, korpus 5, kv. 135; Alexei V. Kuzmin, prospekt Vernadskogo, 89, korpus 2, kv. 64; Gennady A. Smaga, ulitsa Akademicheskaya, 71, kv. 79; Zelik F. Kapchits, Oktyabrskaya ulitsa, 69, kv. 51; Sergei J. Dennikov, ulitsa Veshnyakovskaya, 26, kv. 334, all of Moscow; Peter I. Soosalu, Pyizmyae TEE, 113, kv. 14, Tallin, all of U.S.S.R.

[21] Appl. No.: 232,113

[22] Filed: Feb. 6, 1981

[51] Int. Cl.[3] ..... F23D 11/04

[52] U.S. Cl. ..... 431/168; 239/214.25; 239/223

[58] Field of Search ..... 431/168; 239/214.25, 239/223

[56] References Cited

U.S. PATENT DOCUMENTS 3,220,457 11/1965 Bailey ..... 239/214.25

FOREIGN PATENT DOCUMENTS 1213722 11/1970 United Kingdom ..... 239/214

*Primary Examiner*—Edward G. Favors

*Attorney, Agent, or Firm*—Lilling & Greenspan

[57] ABSTRACT

A rotary burner for liquid fuels includes a casing having a nozzle in which is rotatably mounted a fuel atomizer. The fuel atomizer is made in the form of a cup, which together with an outlet portion of the nozzle forms an annular convergent channel connected to a fuel supply means. On the external surface of the cup, near to an edge thereof, a circular row of vanes is mounted, the vanes being shaped as wedges whose bases face the edge of the atomizing cup.

4 Claims, 6 Drawing Figures

ROTARY BURNER FOR LIQUID FUELS

FIELD OF THE INVENTION

This invention relates to heat and power engineering and more particularly to rotary burners for liquid fuels.

DESCRIPTION OF THE PRIOR ART

Burning of liquid fuels involves difficulties in breaking up and uniform mixing thereof with air.

The use of jet and swirl liquid fuel atomizers, such as disclosed in Federal Republic of Germany Application No. 2,750,718, Cl. B05B 1/100, 1978, which ensure good atomization of low-viscosity fuel, is not effective for viscous fuels as energy losses adversely affect the quality of atomization.

The use of effective methods for intensification of atomization, such as atomization with the helf of a compressed gas and employing ultrasonic generators (cf., e.g., French Patent No. 2,026,912, Cl. B05B, 1970), makes it possible to obtain high-quality atomization, but it is uneconomical, requires a certain amount of compressed gas to be spent, and results in an increased content of nitrogen oxides in the combustion products.

The best results have been obtained in burning viscous fuel, such as masout, in rotary burners comprising a casing provided with a nozzle which rotatably mounts a fuel atomizer made in the form of a cup defining together with an outlet portion of the nozzle an annular convergent channel connected to an air supply means (cf., e.g., U.S. Pat. No. 3,660,006, 1972). In such burners liquid fuel under the action of centrifugal force spreads over the internal surface of the atomizing cup forming a thin liquid film on its edge. As distinct from the swirl liquid fuel atomizers in which the energy of the liquid proper is spent to accelerate liquid flow, to overcome friction forces and surface tension of the liquid in the process of atomizing thereof, in the rotary burners the liquid is provided with an additional energy from a cup rotated, for example, with the help of an electric motor, and issues from the edge of the atomizing cup as a high-velocity, thin annular film dispersing into drops. Air discharged from the convergent channel formed by the nozzle and the cup atomizes the liquid fuel to make up a two-phase flow of a combustible mixture.

However, when viscous, especially non-Newtonian liquids, such as low-grade masout, are atomized by the mentioned devices, the quality of atomizing decreases sharply and non-uniformity of flow of the combustible mixture increases. In the regions of intensive burning and stoichiometric mixture compositions nitrogen oxides are formed, whereas in the regions of non-stoichiometric compositions toxic products of incomplete combustion are formed. Due to this, to provide smokeless operation of such burners, the mean value of excess oxidant ratio $\alpha$ cannot be reduced lower than 1.25 to 1.28, which results in a low thermal efficiency of heat power plants equipped with such burners. If the value $\alpha$ is decreased to increase the thermal efficiency of the burner, the combustion products will contain both smoke and toxic unburnt organic compounds of CO and $CH_4$ type, including cancerogenic substances (3, 4-benzpyrene), as well as nitrogen oxides (mainly NO and $NO_2$).

SUMMARY OF THE INVENTION

It is an object of the present invention to provide a burner of such a design which would ensure more complete combustion of viscous fuel and better economy of burning, as well as a decreased content of toxic substances in flue gases.

This object is achieved in a rotary burner having a casing with a nozzle adapted for axial movement. A fuel atomizer is rotably mounted in the nozzle and made in the form of a cup, which together with an outlet portion of the nozzle forms an annular convergent channel connected to an air supply means.

According to the invention, on the external surface of the cup, near to an edge thereof, a circular row of vanes is mounted; the vanes are shaped as wedges whose bases face the edge of the cup.

Karman vortex streets being formed behind the wedge bases intensify atomization of liquid and a heat-and-mass transfer in the combustion zone and define therein regions of rich and lean combustible mixtures. In their burning out the amount of generated nitrogen oxides drops sharply due to a decreased temperature of combustion and afterburning of unburnt residues takes place in a vortex field defined by spiral Karman streets.

The invention, therefore, provides a two-stage combustion of liquid fuel, wherein a preliminary combustion takes place in the vortex streets formed by the wedge-shaped vanes and in the process of their decay the afterburning of residual combustion products takes place in the rotating flow in the combustion zone.

For better regularity of vortex generation and in order to intensify atomization, one lateral face of each vane is chamfered and the wedge body is provided with a resonant cavity open towards the chamfer of the adjacent wedge. An air stream flowing through the vane channel causes acoustic oscillations in the resonant cavities of the vanes, which radiate into the mixing zone to facilitate atomizing of the liquid film. In addition, these oscillations cause pulsating flow of the air through the vane channels due to which periodic vortex separation from trailing edges of the vanes occurs.

In combustion chambers of high specific heat intensity, the excitation of acoustic oscillations may cause resonance burning dangerous for the chamber structure. To prevent such a phenomenon, it is necessary to desynchronize oscillations generated by the individual resonators. According to the invention this is achieved by the resonant cavities of the adjacent vanes having diameters which differ from a mean diameter by 12 to 36 percent.

A less than 12 percent variation does not provide the necessary discrepancy between the frequencies because of low goodness of the combustion chamber as an acoustic cavity and may cause excitation of undesirable low-frequency beats between the excited oscillations.

A greater than 36 percent variation may result in appearance of multiple harmonics of oscillations which hamper reliable operation of the burner.

BRIEF DESCRIPTION OF THE DRAWINGS

The invention is described in detail below with reference to the attached drawings wherein.

DETAILED DESCRIPTION OF THE INVENTION

Figure 1:
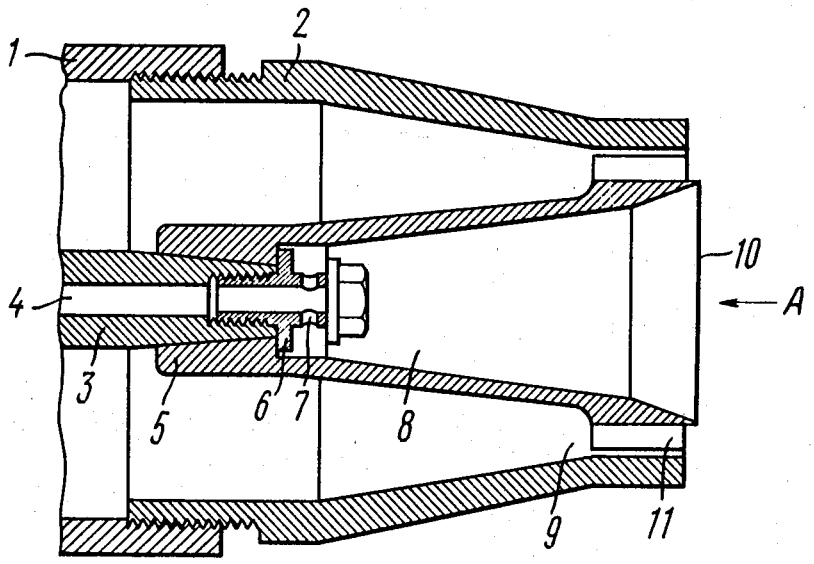
FIG. 1 is a longitudinal sectional view of a rotary burner, according to the invention.
Figure 2:
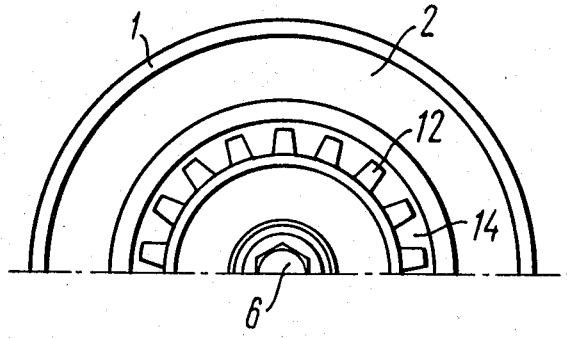
FIG. 2 is a view of a burner, taken in the direction of the arrow A in FIG. 1.
Figure 3:
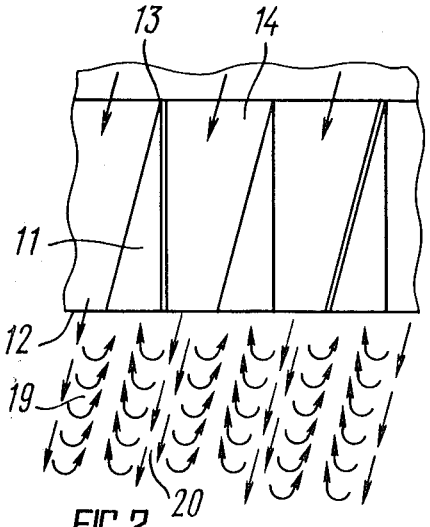
FIG. 3 is a developed view of an external surface of the atomizing cup having vanes, wherein air flow over a vane rim is schematically illustrated.

A rotary burner, shown in FIG. 1, comprises a casing 1 mounting a nozzle 2 adapted for axial movement, a shaft 3 having a fuel duct 4, and an atomizing cup 5 secured to the shaft 3 by means of a fuel distributor 6 provided with ports 7 to communicate an inner space 8 of the cup 5 with the fuel duct 4. The external surface of the cup 5 defines together with the casing 1 and the nozzle 2 an annular convergent channel 9 to supply air under pressure. Near an edge 10 of the cup 5, a circular row of vanes 11 is mounted, each having a bluff base 12 (FIG. 2) and a sharp leading edge 13 (FIG. 3).

Thus, the vanes 11 shaped as wedges form channels 14 tapering in the direction of flow.

Figure 4:
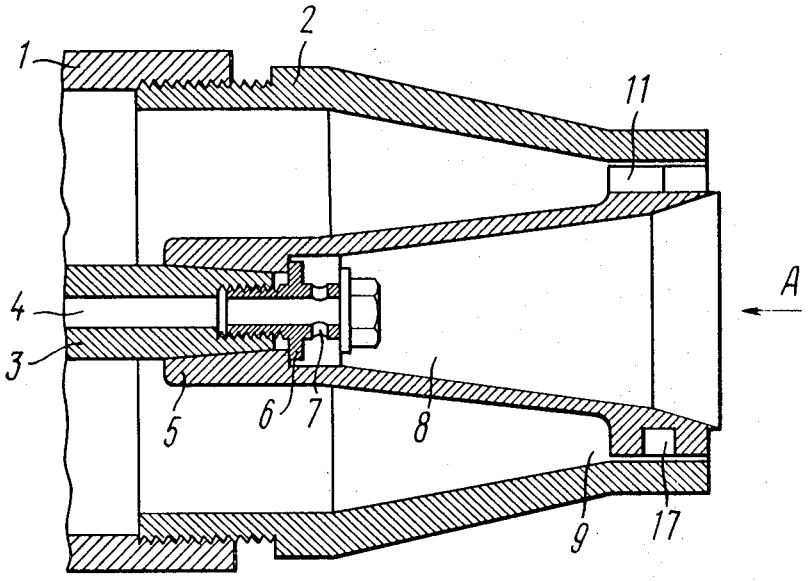
FIG. 4 is a longitudinal sectional view of an alternative embodiment of an atomizing member provided with resonant cavities in the vanes.
Figure 5:
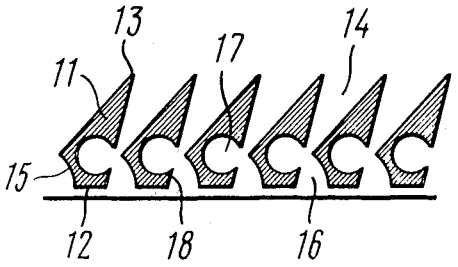
FIG. 5 is a developed view of a vane rim having the resonant cavities in the vanes.

The vanes 11 (FIG. 4) of the rotary burner may have chamfers 15 (FIG. 5) made at their bases 12 and forming a portion 16 of the channel 14, which widens in the direction of flow. In the body of each blade 11, near to a narrow section of the channel 14, provided is a resonant cavity 17 facing the chamfer 15 of the adjacent vane and forming together with a face of the vane 11 a sharp edge 18 directed towards the flow of air in the channel 14.

The device operates as follows.

Figure 6:
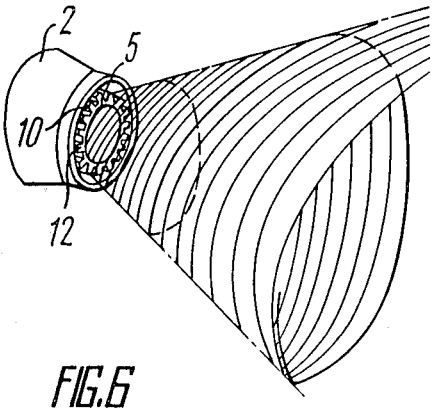
FIG. 6 schematically illustrates how vortices propagate within the burner space, according to the invention.

With the shaft 3 rotating together with the cup 5 (FIG. 1), the fuel is fed into the inner space of the cup 5 through the duct 4 and the ports 7 of the distributor 6, spreads over the periphery of the cup 5 under the action of centrifugal force and issues from the edge 10 of the cup 5 in the form of a thin annular film dispersing into drops. The compressed air supplied into the inner space of the casing 1 flows through the convergent channel 9 and channels 14 (FIG. 2) defined by the vanes 11 towards the fuel film. When the air streams flow over the bases 12 (FIG. 3) of the vanes 11, regions of oppositely swirled flows 19 (so called Karman streets) are formed behind the vanes 11, characterized by an increased turbulence and a decreased velocity as compared with that of an undisturbed flow 20. On entering the flows 19 and 20, the fuel film disperses into minute drops and forms with the air a combustible mixture of various concentration, viz., rich in the vortex streets 19 and lean in the flows 20. With the cup 5 rotating, the flows 19 and 20 acquire a spiral shape (FIG. 6) defining the lengthwise alternating regions of burning of rich and lean mixtures. On being ignited, these regions burn out at temperatures which are lower than stoichiometric combustion temperatures, thereby incomplete combustion products free from nitrogen oxides being formed.

While further moving in the combustion zone, these products due to turbulence mixing in the vortex field produced by the vanes 11 quickly burn out one within the other. In this case, substantially complete combustion is effected with formation of an inconsiderable amount of nitrogen oxides because of low concentration of oxygen in the lean products of incomplete combustion and quick afterburning.

If the vanes 11 are provided with the chamfers 15 (FIG. 5) and the resonant cavities 17, acoustic oscillations generated therein, when the air stream from the channels 14 flows over the sharp edges 18, regulate formation of vortex pairs in the Karman streets 19 (FIG. 3) and, in addition, generate pressure waves which assist in thoroughly breaking up fuel drops. In this case, heterogeneities in the composition of combustible mixture are formed not only lengthwise of the combustion zone, but also lengthwise of the vortex streets 19.

If the resonant cavities provided in the adjacent vanes 11 have diameters varying from vane to vane, oscillations of different frequency are generated therein which prevents resonance burning in the combustion chamber. Variation in the diameters of the resonant cavities from a means value thereof strictly within the range from 0.12 to 0.36 ensures suppression of multiple harmonics of oscillations which improves the stability of burning.

What is claimed is:

1. A rotary burner for viscous liquid fuels, comprising a casing; a nozzle mounted on said casing for axial movement; a fuel atomizer rotatably mounted in said nozzle made in the form of a cup which together with an output portion of the nozzle defines an annular convergent channel connected to an air supply means; a circular row of vanes shaped as wedges whose bases face the cup edge, and mounted on an external surface of the cup near to an edge of said cup.

2. A rotary burner as claimed in claim 1, wherein one lateral face of each vane has a chamfer and the body of the vane is provided with a resonant cavity open towards the chamfer of an adjacent vane.

3. A rotary burner as claimed in claim 2, wherein the diameters of the resonant cavities vary from a mean diameter thereof within a range of 0.12 to 0.36.

4. A rotary burner as claimed in claim 1, wherein each of said vanes has a bluff base and a sharp leading edge, and said vanes define channels tapering in the direction of air flow.

* * * * *